United States Patent [19]

Pearson

[11] Patent Number: 4,819,461

[45] Date of Patent: Apr. 11, 1989

[54] TRUCK CANOPY AND TAILGATE LOCKING MEANS

[76] Inventor: M. Nicholas Pearson, 23516 94th W., Edmonds, Wash. 98020

[21] Appl. No.: 207,191

[22] Filed: Jun. 16, 1988

[51] Int. Cl.[4] ..... E05B 73/00

[52] U.S. Cl. ..... 70/14; 70/164; 70/212; 70/237; 70/238; 70/DIG. 64; 70/DIG. 65; 292/259 R; 292/289; 292/DIG. 43

[58] Field of Search ..... 70/14, 19, 57, 93, 94, 70/124, 164, 211, 212, 237, 238, DIG. 64, DIG. 65; 292/DIG. 29, DIG. 43, DIG. 1, 288, 289, 258, 259 R, 259 A, 339

[56] References Cited

U.S. PATENT DOCUMENTS

| | | | |
|---|---|---|---|
| 1,333,878 | 3/1920 | Smith | 70/14 |
| 2,463,195 | 3/1949 | Mungan | 70/211 X |
| 2,537,380 | 1/1951 | Travis | 292/288 |
| 2,618,497 | 11/1952 | Gardels | 292/DIG. 43 X |
| 2,908,522 | 10/1959 | Glave | 292/DIG. 43 X |
| 2,973,217 | 2/1961 | Gregoire | 292/DIG. 43 X |
| 3,117,689 | 1/1964 | Dedic, Sr. | 292/DIG. 43 X |
| 4,004,833 | 1/1977 | Hull | 292/288 |
| 4,389,862 | 6/1983 | Hastings | 70/14 X |
| 4,488,417 | 12/1984 | Werner | 70/14 X |

*Primary Examiner*—Lloyd A. Gall

[57] ABSTRACT

A locking device to secure the rear door and tailgate of a truck equipped with a canopy and a rear bumper comprising an elongated member having a loop at the upper end for securing the handle apparatus of a truck canopy and a lower member with circular orifices that extends vertically through an orifice in the bumper. A locking means is accomplished by the use of a padlock in conjunction with the circular orifices in the lower member of the locking device.

2 Claims, 1 Drawing Sheet

Fig. 1.
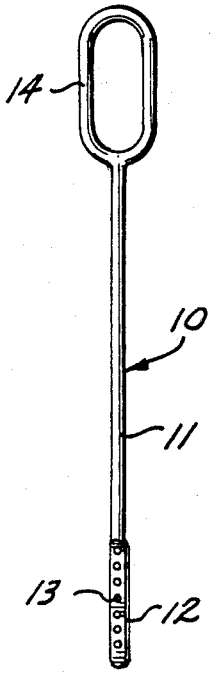
Fig. 2.
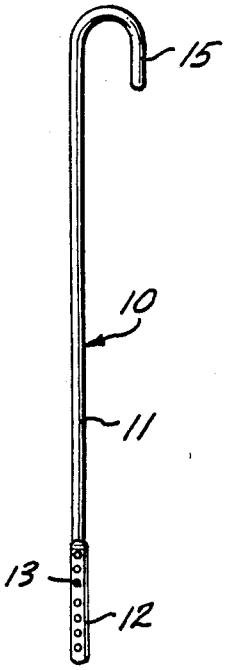
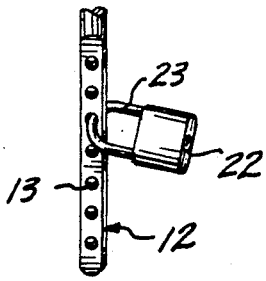
Fig. 3.
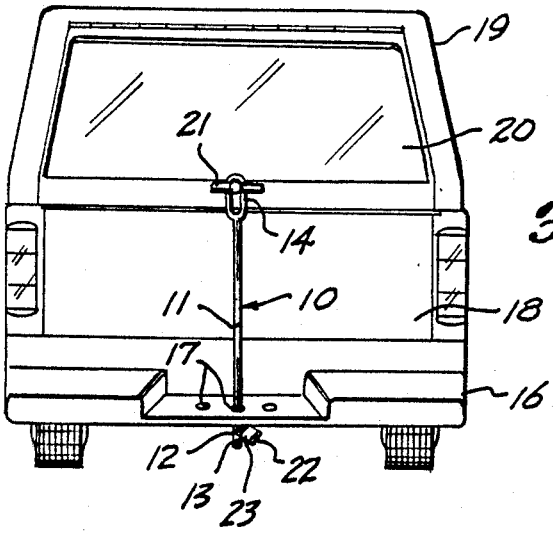
Fig. 4.

TRUCK CANOPY AND TAILGATE LOCKING MEANS

BACKGROUND OF THE INVENTION

1. Field Of Invention

This invention pertains to a locking device for securing a truck canopy rear door and tailgate against forcible entry.

2. Background Of Invention

Presently the locking mechanisms employed on many models of truck canopies provide little more than superficial security. These locking devices do not provide adequate design provisions to insure that the truck canopy rear door and truck tailgate are secure from forced entry. Many of these truck canopy rear doors and truck tailgates can be pulled open easily without the aid of a tool or pried open with the use of a pry bar or other leverage device. This invention is designed to provide a more reliable locking means to prevent the forced opening of a truck canopy rear door and truck tailgate.

OBJECTS AND ADVANTAGES

Accordingly I claim the following objects and advantages of the invention: The object of this invention is to provide an adjustable locking bar comprising a loop provision thereon which secures about the handle apparatus of a truck canopy and vertically extends through an orifice in the bumper. A locking means is accomplished by use of a padlock in conjunction with several circular orifices in the base of the bar.

The advantages of this invention are to provide a locking means which is an improvement over other means of securing a truck canopy rear door and truck tailgate, to provide a more reliable means of preventing the forced opening of a truck canopy rear door and truck tailgate, to provide a locking means which affords a high degree of security without modification of the truck canopy, truck tailgate, or any other body or frame member and to provide a locking means for the truck canopy rear door and truck tailgate that is simple, economical and easily fabricated.

Further objects and advantages of my invention will become apparent from consideration of the drawings and ensuing description of it.

BRIEF DESCRIPTION OF THE DRAWINGS FIG. 1 shows a view of an elevation of an embodiment of the truck canopy and tailgate locking means. FIG. 2 shows a view of an elevation of another embodiment of the truck canopy and tailgate locking means. FIG. 3 shows a view of the lower member as shown in FIG. 1 of the truck canopy and tailgate locking means. FIG. 4 shows a perspective view of the truck canopy and tailgate locking means in use.

DRAWING REFERENCE NUMERALS

10 truck canopy and tailgate locking means
11 elongated member
12 lower member
13 graduated circular orifices
14 loop (in upper end of elongated member)
15 hook (in upper end of elongated member)
16 truck bumper
17 bumper orifices
18 truck tailgate
19 truck canopy
20 rear door

21 rear door handle apparatus
22 padlock
23 padlock hasp

DETAILED DESCRIPTION

FIG. 1 shows a view of the preferred embodiment of the invention. Referring now to the drawing in detail the truck canopy and tailgate locking means will be referred to by the numeral 10. This device 10 is comprised of a rigid elongated bar 11 with a lower member 12 containing graduated circular orifices 13 and a loop 14 at the upper end which is an integral portion of the elongated bar bent into the shape of a loop. The loop 14 is designed to secure to the rear door handle apparatus 21 with the elongated bar 11 extending vertically downward to an orifice 17 in the truck bumper 16 into which the lower member 12 is inserted. The graduated circular orifices 13 in the lower member will extend through the bumper orifice 17, the circular orifices 13 are graduated to accommodate variations in distance between the rear door handle apparatus 21 and bumper orifices !7, when a padlock hasp 23 is inserted through one of the lower member 12 graduated circular orifices 13 on the bottom side of the truck bumper !6 in a manner so as to minimize movement of the elongated bar 11 between the rear door handle apparatus 21 and the truck bumper 16, by the minimizing of the movement of elongated bar 11 the rear door 20 will not swing upward to an open position and by the close vertical proximity of the elongated bar 11 to the truck tailgate lB it is prevented from swinging downward to an open position.

Referring to FIG. 2, an embodiment of the invention is shown which is similar to the embodiment shown in FIG. 1, except that the top end of the elongated member 11, is in the shape of a hook 15, that is designed to accomplish the same purpose as the loop 14.

The entire structure is comprised of hardened steel of sufficient gauge so that it cannot be cut with ordinary bolt cutting devices. It is also desirable to coat the device with a protective coating of soft plastic or rubber or any other similar protective material to protect the finish of the components of the truck and truck canopy that the device may come into contact with.

The device as described is simple in principle and construction and yet is a highly effective device for preventing the forced entry of a truck canopy and truck tailgate.

It is to be understood that the present disclosure of the invention is for the purpose of illustration only and is not limited to the exact construction illustrated an described above and that various changes and modifications may be made without departing from the scope and spirit of the invention defined by the appended claims.

I claim:

1. A locking device comprising an elongated bar having a shaped end which secures about the handle apparatus of truck canopy rear door and having an attached lower member having a plurality of circular orifices to define a hasp receiving passage which extends vertically through an orifice in a truck bumper with said hasp receiving passage, whereby to permit the passage of the hasp of a lock therethrough for preventing movement of said elongated bar between said handle apparatus and said truck bumper.

2. The locking device in claim 1, further comprising a padlock including a hasp disposed within said hasp receiving passage in said lower member.

* * * * *